US008308525B2

(12) United States Patent
Hashish et al.

(10) Patent No.: US 8,308,525 B2
(45) Date of Patent: Nov. 13, 2012

(54) PROCESSES AND APPARATUSES FOR ENHANCED CUTTING USING BLENDS OF ABRASIVE MATERIALS

(75) Inventors: Mohamed Hashish, Bellevue, WA (US); Steven J. Craigen, Auburn, WA (US)

(73) Assignee: Flow Internationl Corporation, Kent, WA (US)

( * ) Notice: Subject to any disclaimer, the term of this patent is extended or adjusted under 35 U.S.C. 154(b) by 1031 days.

(21) Appl. No.: 12/272,577

(22) Filed: Nov. 17, 2008

(65) Prior Publication Data

US 2010/0124872 A1 May 20, 2010

(51) Int. Cl.
*B24B 49/00* (2012.01)

(52) U.S. Cl. ..... 451/5; 451/36; 451/38; 451/90; 451/99; 451/102; 451/446

(58) Field of Classification Search ..... 451/5, 36, 451/38–40, 90, 99, 102, 446
See application file for complete search history.

(56) References Cited

U.S. PATENT DOCUMENTS

| | | | | |
|---|---|---|---|---|
| 5,024,029 | A * | 6/1991 | Abbott et al. | 451/101 |
| 5,643,058 | A * | 7/1997 | Erichsen et al. | 451/99 |
| 5,752,829 | A * | 5/1998 | Goldsmith et al. | 433/88 |
| 5,759,086 | A * | 6/1998 | Klingel | 451/28 |
| 5,800,246 | A * | 9/1998 | Tomioka | 451/2 |
| 6,000,308 | A | 12/1999 | LaFountain et al. | |
| 6,280,302 | B1 | 8/2001 | Hashish et al. | |
| 6,503,126 | B1 * | 1/2003 | Rhoades | 451/36 |
| 6,769,959 | B2 * | 8/2004 | Chen et al. | 451/8 |
| 6,814,649 | B2 * | 11/2004 | Schmall | 451/2 |
| 7,040,959 | B1 * | 5/2006 | Panuska et al. | 451/36 |
| 7,108,585 | B1 | 9/2006 | Dorfman et al. | |
| 7,459,028 | B2 * | 12/2008 | Kral et al. | 134/7 |
| 7,544,112 | B1 * | 6/2009 | Miller et al. | 451/2 |
| 2003/0037654 | A1 * | 2/2003 | Sciulli et al. | 83/177 |

FOREIGN PATENT DOCUMENTS

WO 0056466 A2 9/2000

* cited by examiner

*Primary Examiner* — George Nguyen
(74) *Attorney, Agent, or Firm* — Seed IP Law Group PLLC

(57) ABSTRACT

A waterjet system selectively produces fluid jets for water jet cutting or abrasive jets for abrasive-waterjet-cutting. The abrasive materials in the abrasive jet are determined based on the properties of the workpiece. The waterjet system includes an abrasive delivery system that is capable of delivering either a single abrasive or a plurality of abrasives as an abrasive blend, to a cutting head assembly. The cutting head assembly entrains the abrasive into a fluid jet to form an abrasive jet.

18 Claims, 10 Drawing Sheets

PROCESSES AND APPARATUSES FOR ENHANCED CUTTING USING BLENDS OF ABRASIVE MATERIALS

BACKGROUND

1. Technical Field

The present invention relates generally to waterjet systems and, in particular, to abrasive jet systems capable of producing multi-abrasive jets.

2. Description of the Related Art

Conventional waterjet systems are used to process workpieces by pressurizing fluid and then delivering the pressurized fluid against a workpiece. An abrasive jet system is a type of waterjet system that produces a high-pressure abrasive jet suitable for cutting through relatively hard materials. Abrasive jet systems often have a jewel orifice in a cutting head assembly. High-pressure fluid flows through the jewel orifice to form a high-pressure fluid jet inside of the cutting head assembly. Abrasive is entrained in the fluid jet to produce an abrasive jet. The abrasive jet passes through a mixing tube retained by a cutting head body and is ultimately discharged towards the workpiece.

Garnet abrasive is commonly used to produce abrasive jets suitable for cutting a wide range of different materials while producing a minimal amount of wear along the mixing tube. Unfortunately, cutting rates achieved utilizing garnet abrasive may be relatively low, especially when cutting workpieces made of hard, wear-resistant materials, such as ceramics (e.g., alumina ceramic, zirconia, etc.), ceramic matrix composites, carbides (e.g., tungsten carbide, titanium carbide, and the like), sapphire, and other materials capable of withstanding exposure to abrasive jets, such as materials often used to make armor (e.g., armor for military vehicles, body armor, etc.). Even though garnet abrasive has a low material cost, it may result in an expensive, time consuming manufacturing process, especially if used to cut these hard, wear-resistant materials, thus rendering it unsuitable for cost-effective processing.

Relatively hard abrasive, such as aluminum oxide, can be used to cut hard, wear-resistant materials at relatively high cutting speeds. Unfortunately, hard abrasives often have a high material cost and produce high wear rates of the mixing tube that result in frequent mixing tube replacement. When an abrasive jet carrying only hard abrasive passes through the mixing tube at a high velocity, the mixing tube, even if made of a wear-resistant material, experiences appreciable wear. Mixing tubes have to be replaced periodically within a time as short as a half hour, or perhaps as long as 100 hours, depending upon the material forming the mixing tube, as well as other factors, such as the hardnesses of entrained abrasive, working pressures, flow rates, manufacturing tolerances, etc. Frequent replacement of worn mixing tubes often leads to problems, such as damage to the cutting head body, misalignment of the mixing tube, machine downtime, and the like. Accordingly, hard abrasive is unsuitable for cost-effective processing. Also, increasing the working pressure of the fluid used to make the abrasive jet may not significantly increase cutting rates of many types of hard materials.

BRIEF SUMMARY

In some embodiments, a waterjet system is adapted to produce different types of jets. The jets can be fluid jets for waterjet cutting or abrasive jets for abrasive waterjet cutting. The abrasive constituents of the abrasive jet, in some embodiments, are varied based on the properties of the workpiece.

The waterjet system includes an abrasive delivery system and a cutting head assembly capable of entraining abrasive from the abrasive delivery system to produce abrasive jets.

The abrasive jet, in some embodiments, includes an abrasive blend. Various types of processes (e.g., mixing processes) can be used to produce abrasive blends before, during, and/or after the entrainment process, as discussed in further detail below. The composition of the abrasive blend is selected based on different manufacturing parameters. In some modes of operation, the cutting head assembly receives separate flows of abrasive and mixes those flows to produce the abrasive blend. The abrasive blend is entrained in a fluid jet to form the abrasive jet. In other modes of operation, the cutting head assembly receives an abrasive blend from the abrasive delivery system and entrains that abrasive blend. In some embodiments, the abrasive blend is stored in and dispensed from an abrasive source, such as a hopper.

Separate components of the waterjet system can independently form the abrasive blend and the fluid jet. In some embodiments, a mixing manifold produces the abrasive blend, and the cutting head assembly produces the fluid jet. The abrasive delivery system controls feed rates of different abrasives to control the relative amounts of abrasives in the abrasive blend, thus controlling the composition of the abrasive jet. The composition of the abrasive jet is varied to vary cutting rates, wear rates, and the like.

The waterjet system, in some embodiments, has a mixing manifold positioned between a plurality of metering units and a cutting head assembly. Abrasive from the metering units travels through the mixing manifold and then into the cutting head assembly. When the metering units cooperate to output a plurality of abrasive flows, the mixing manifold receives and combines the plurality of flows to produce the abrasive blend.

In some embodiments, an abrasive waterjet system comprises a first abrasive feed apparatus, a second abrasive feed apparatus, and a cutting head assembly. The first abrasive feed apparatus is adapted to output a first abrasive material. The second abrasive feed apparatus is adapted to output a second abrasive material. The cutting head assembly includes an orifice member configured to produce a fluid jet, a mixing chamber configured to receive the first abrasive material and a second abrasive material and to concurrently combine both the first abrasive material and the second abrasive material within a section of the fluid jet located in the mixing chamber to produce a multi-abrasive jet.

In some embodiments, an abrasive mixing system comprises a first metering unit, a second metering unit, and a mixing manifold. The first metering unit is adapted to output a first abrasive. The second metering unit is adapted to output a second abrasive. The mixing manifold includes a first inlet coupled to the first metering unit, a second inlet coupled to a second metering unit, and a mixing region in which the first abrasive passing through the first inlet and the second abrasive passing through the second inlet are mixed. The mixing manifold further includes an outlet coupleable to a line capable of delivering the first abrasive and the second abrasive exiting the mixing region to a cutting head assembly for generating an abrasive jet.

In other embodiments, a method for producing a multi-abrasive jet is provided. The method includes producing a fluid jet, delivering a flow of a first abrasive into a mixing chamber in a cutting head assembly of a waterjet system, and delivering a flow of second abrasive material into the mixing chamber. The first abrasive and the second abrasive are simultaneously entrained into a section of the fluid jet within the mixing chamber to form the multi-abrasive jet.

In some other embodiments, a method for producing a multi-abrasive jet comprises producing a nonabrasive fluid jet passing through a mixing chamber in a cutting head assembly. A first abrasive is entrained into a section of the nonabrasive fluid jet located within the mixing chamber. A second abrasive is entrained into the section as the first abrasive is entrained. The first abrasive is different from the second abrasive.

BRIEF DESCRIPTION OF THE SEVERAL VIEWS OF THE DRAWINGS

In the drawings, identical reference numbers identify similar elements or acts.

DETAILED DESCRIPTION

Figure 1:
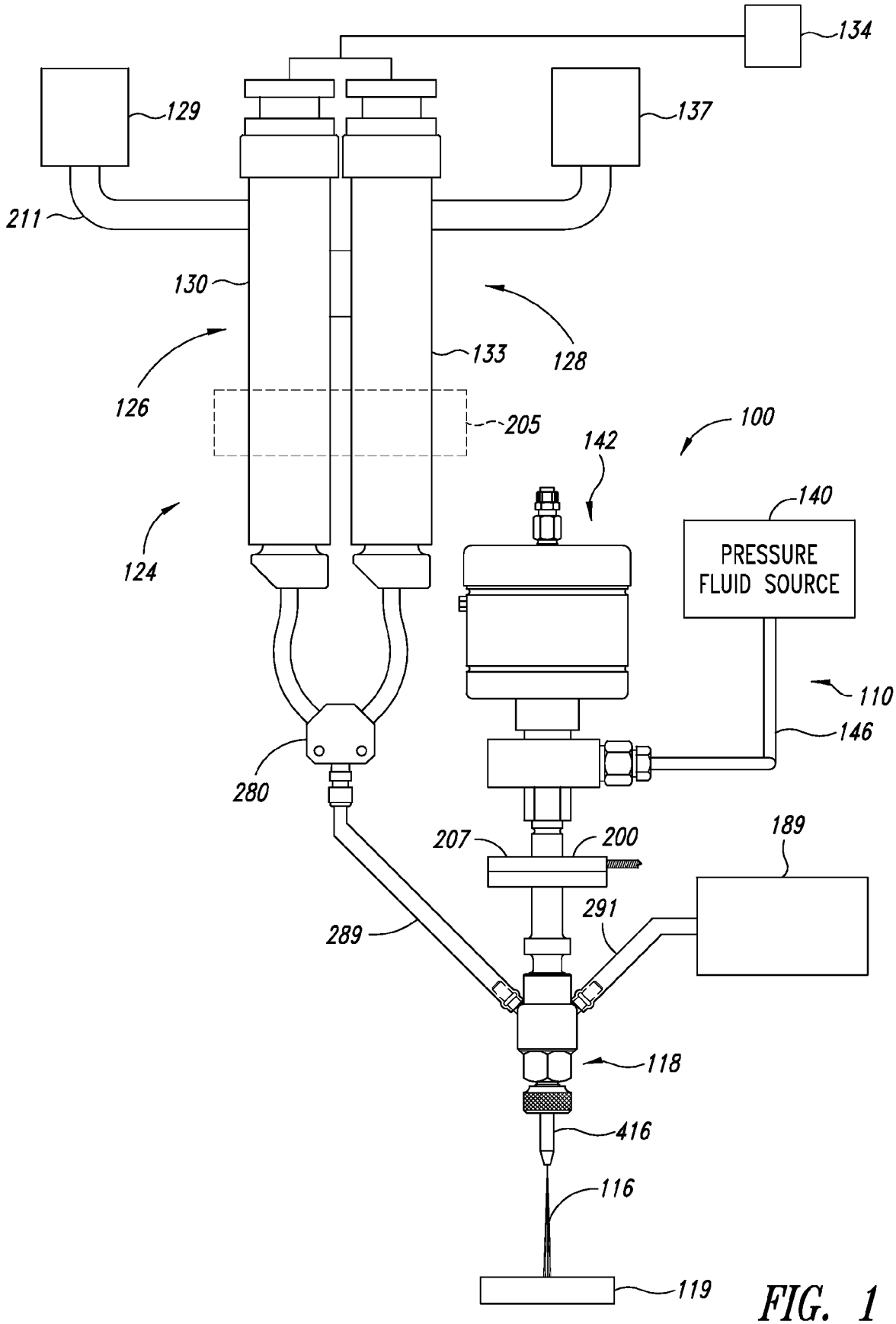
FIG. 1 is an elevational view of a waterjet system processing a workpiece, in accordance with one embodiment.

FIG. 1 shows a waterjet system 100 producing a jet 116 that is processing a workpiece 119. The waterjet system 100 generally includes a cutting head assembly 118, a fluid delivery system 110 for delivering pressurized fluid to the cutting head assembly 118, and an abrasive delivery system 124 for delivering abrasive to the cutting head assembly 118. The abrasive delivery system 124 generally includes a first abrasive feed apparatus 126, a second abrasive feed apparatus 128, and a mixing manifold 280 between the first and second feed apparatuses 126, 128 and the cutting head assembly 118.

To produce a fluid jet, the abrasive delivery system 124 can be OFF while the fluid delivery system 110 delivers pressurized fluid (e.g., water) to the cutting head assembly 118. The cutting head assembly 118 uses the pressurized fluid to produce the fluid jet 116. To produce an abrasive jet, the abrasive delivery system 124 is turned ON and delivers abrasive to the cutting head assembly 118. The cutting head assembly 118 combines the abrasive and pressurized fluid from the fluid delivery system 110 to produce the abrasive jet 116. The abrasive can be a single abrasive for producing a single-abrasive jet or an abrasive blend for producing a multi-abrasive jet. The abrasive delivery system 124 controls the composition of the abrasive blend for achieving one or more desired processing criteria, such as processing speeds (e.g., cutting speeds, deburring speeds, drilling speeds), processing tolerances, finishes (e.g., smooth finishes, rough cuts, and the like), wear rates of one or more waterjet system components (e.g., a mixing tube, a cutting head body, and the like), material costs of abrasives, working pressures, and the like.

The illustrated abrasive delivery system 124 is capable of producing a dual-abrasive blend. Dual-abrasive blends generally refer to abrasive blends that are comprised primarily of two different types of abrasives. In some embodiments, a dual-abrasive blend is a mixture of soft abrasive, such as garnet abrasive, and hard or ultra-hard abrasive, such as aluminum oxide abrasive. To cut the workpiece 119, the relative amount by weight of the hard abrasive in the blend can be increased or decreased to increase or decrease, respectively, cutting speeds. Such abrasive blends may be well suited for cutting workpieces made of hard materials, such as ceramics, ceramic matrix composites, carbides, sapphire, and other hard materials. The relative amount of hard abrasive can be increased until the desired cutting speed is obtained. The composition of the abrasive blend can be changed during a single processing routine to account for different material properties in different regions of the workpiece 119. To reduce the wear rate of components of the cutting head assembly, the amount of hard abrasive in the blend can be decreased, thereby reducing the frequency of component replacement.

As used herein, the term "fluid jet" generally refers to a jet made only of one or more fluids (e.g., a single fluid or a mixture of fluids), unless the context clearly dictates otherwise. The term "abrasive jet" generally refers to a jet comprising one or more fluids and one or more abrasives. Abrasive jets can be single-abrasive jets or multi-abrasive jets. A single-abrasive jet generally includes only one abrasive material (e.g., garnet abrasive). Of course, the single-abrasive jet may include an insignificant amount of other solid abrasive particles (e.g., abrasive particles from prior processing that become trapped in the cutting head body and subsequently dislodged and picked-up by the jet). In some embodiments, the total abrasive in the single-abrasive jet 116 includes at least 95% by weight of one type of abrasive. In yet other embodiments, the total abrasive in the single-abrasive jet 116 includes at least 98% by weight of one type of abrasive. A multi-abrasive jet generally includes two or more abrasives, such as solid particles of a first abrasive material and solid particles of another abrasive material. Any number of different types of abrasive materials can be combined to produce the multi-abrasive jet.

The composition of the abrasive can be selected based on the properties of the workpiece 119. Some embodiments use abrasive particles on the order of about 220 mesh or finer. Exemplary soft abrasive materials include, without limitation, garnet particles, silica sand, glass particles, combinations thereof, and the like. Soft abrasive has a hardness in a range of about 6 to about 7 measured on the Mohs scale. Various types of tests (e.g., Mohs hardness test, Vickers hardness test, etc.) can be used to determine the hardness of abrasives. Hard abrasive has a hardness in a range of about 8 to about 9 measured on the Mohs scale and include, without limitation, aluminum oxide. Ultra-hard abrasive has a hardness in a range of about 8.5 to about 9.1 measured on the Mohs scale and include, without limitation, silicon carbide with a hardness in the range of about 9 to 10 on the Mohs scale. The number and types of abrasives can be selected based on whether the abrasive jet abrades, cuts, drills, etches, polishes, cleans, or serves another function. If the workpiece 119 is made of a hardened material, the abrasive can be solid particles that are harder than the material of the workpiece 119. If the jet 116 is a multi-abrasive jet, the relative amount of a hard abrasive material can be increased to increase processing speeds. If the workpiece 119 is made of a relatively soft material, the relative amount of the hard abrasive can be decreased while keeping the processing speed at or above a desired level.

The fluid delivery system 110, the abrasive delivery system 124, and the cutting head assembly 118 can therefore cooperate to achieve a wide range of parameters of the jet 116, including, without limitation, flow rates (e.g., mass flow rates of abrasive, volumetric flow rates, and the like), flow velocities, levels of homogeneity of the fluid jet 116, compositions of the jet 116 (e.g., ratios of abrasive to pressurized fluid), or combinations thereof. These flow parameters can be adjusted based on various processing criteria known in the art.

FIG. 1 shows a controller 134 communicatively coupled to the first and second feed apparatuses 126, 128 to control the delivery of abrasive to the mixing manifold 280. The controller 134 may generally include, without limitation, one or more computing devices, such as controllers, processors, microprocessors, digital signal processors (DSP), application-specific integrated circuits (ASIC), and the like. To store information, the controller 134 may also include one or more storage devices, such as volatile memory, non-volatile memory, read-only memory (ROM), random access memory (RAM), and the like. The storage devices can be coupled to the computing devices by one or more busses. The controller 134 may further include one or more input devices (e.g., displays, keyboards, touchpads, controller modules, or any other peripheral devices for user input) and output devices (e.g., displays screens, light indicators, and the like). The controller 134 can store one or more programs for processing any number of different workpieces. In some embodiments, the controller 134 stores a first executable program for processing a first workpiece and a second executable program for processing a second workpiece. In some embodiments, including the illustrated embodiment, the controller 134 is configured to control a first feed rate of abrasive from a first abrasive metering unit 130 and a second feed rate of abrasive from a second abrasive metering unit 133. By adjusting these feed rates, a ratio of abrasives delivered to the cutting head assembly 118 can be selectively increased or decreased, if needed or desired. The controller 134 can also control operation of other components, such as the fluid delivery system 110.

With continued reference to FIG. 1, the first abrasive feed apparatus 126 includes a first abrasive source 129 for holding abrasive and the first metering unit 130 for receiving and dispensing abrasive from the first abrasive source 129. The second abrasive feed apparatus 128 includes a second abrasive source 137 for holding another abrasive and the second metering unit 133 for receiving and dispensing the abrasive from the second abrasive source 137.

The fluid delivery system 110 includes a pressure fluid source 140, a fluid manifold assembly 142, and a fluid line 146 extending between the pressure fluid source 140 and the fluid manifold assembly 142. The term "line," as used herein includes, without limitation, one or more tubes, conduits, or other components through which substances (e.g., fluids, abrasives, and the like) can flow. In some embodiments, the fluid line 146 is a flexible tube through which a stream of pressurized fluid (e.g., water) flows. The pressure fluid source 140 may include, without limitation, one or more pumps capable of applying a wide range of pressures. Pressurized fluid from the pressure fluid source 140 flows through the fluid line 146 and into the fluid manifold assembly 142. The fluid flows through the fluid manifold assembly 142 and into the cutting head assembly 118. Inside the cutting head assembly 118, a fluid jet is generated and entrains abrasive so as to produce the abrasive jet 116.

A secondary pressurization source 189 is coupled to the cutting head assembly 118 via a line 291. In some embodiments, the pressurization source 189 includes, without limitation, a pump (e.g., a low pressure or vacuum pump) capable of applying a relatively low pressure or vacuum to adjust the pressure or flow characteristics in the cutting head assembly 118. In other embodiments, the pressurization source 189 is capable of withdrawing at least some of the contents of the cutting head assembly 118 through the line 291, thereby adjusting the performance of the waterjet system 100. In some embodiments, the pressurization source 189 can be removed to simplify construction and operation of the cutting head assembly 118.

In some embodiments, including the illustrated embodiment of FIG. 1, an actuation system 200 is provided for selectively moving the cutting head assembly 118. The actuation system 200 can be in the form of a positioning table (e.g., X-Y positioning table, X-Y-Z positioning table, multi-axis robots such as 2-axis robots or 6-axis robots, and the like) driven by a drive mechanism. Motors (e.g., stepper motors) can drive the table to control the movement of the cutting head assembly 118. The actuation system 200, in some embodiments, moves both the cutting head assembly 118 and the abrasive delivery system 124. For example, the abrasive delivery system 124 can be physically coupled to the fluid manifold assembly 142 or the actuation system 200, or both. Other types of positioning systems employing linear slides, rail systems, motors, and the like can be used to selectively move the cutting head assembly 118 as needed or desired. U.S. Pat. No. 6,000,308, which is herein incorporated by reference in its entirety, discloses systems, components, and mechanisms that can be used to position the cutting head assembly 118. The actuation system 200 can also carry at least one of the first metering unit 130 and the second metering unit 133. For example, a holder 205 can be part of the actuation system 200. In some embodiments, a holder 207 is fixedly coupled to and carries the cutting head assembly 118, the first metering unit 130, and the second metering unit 133. Each of these components can extend through the illustrated holder 207. The holder 207 can include clamps, brackets, or the like.

Figure 2:
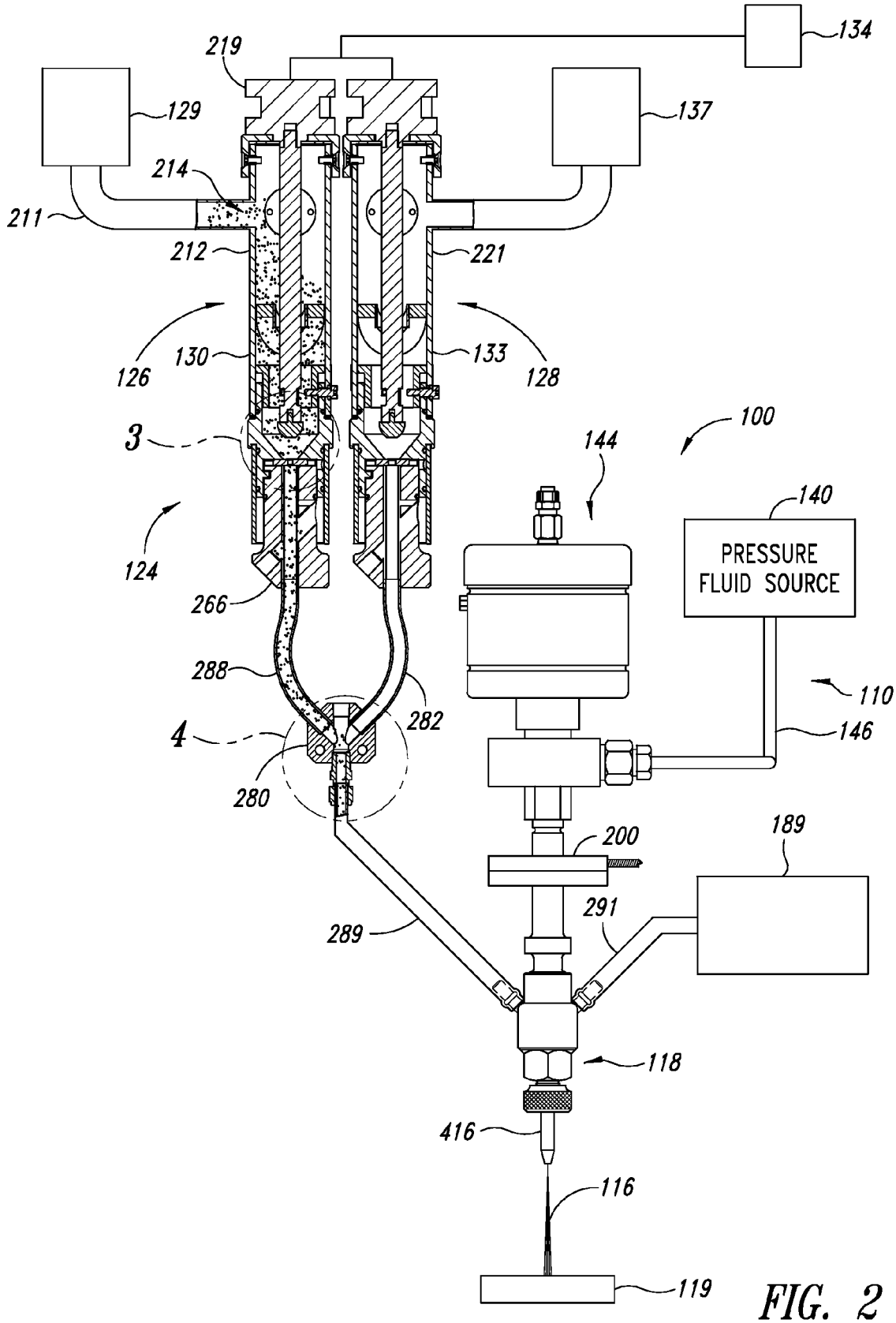
FIG. 2 is a partial cross-sectional, elevational view of the waterjet system of FIG. 1.

The first and second feed apparatuses 126, 128 can be generally similar to each other and, accordingly, the following description of one of the feed apparatuses applies equally to the other, unless indicated otherwise. Referring to FIGS. 1 and 2, the first abrasive feed apparatus 126 includes the first abrasive source 129 (illustrated as a hopper), the first metering unit 130, and a line 211 extending between the hopper 129 and the first metering unit 130. A stream of abrasive from the hopper 129 flows through the line 211 and into the first metering unit 130.

The hopper 129 can be a container (e.g., a funnel-shaped container, a bulk hopper, and the like) in which abrasive can be stored for dispensation. The abrasive is delivered to the first metering unit 130 using compressed air. The hopper 129 can store different types of abrasives or abrasive blends. The blends can include, without limitation, at least two different types of abrasives that are combined together to form heterogeneous or homogenous mixtures.

FIG. 2 shows the first metering unit 130 receiving abrasive from the hopper 129 and dispensing that abrasive at a desired rate. The first metering unit 130 includes an air isolator 212 having an inlet port 214 coupled to the line 211. One or more vents proximate a top region of the air isolator 212 can provide venting. Venting air helps ensure that the flow rate of abrasive through the first metering unit 130 is generally independent of the pressure of the air pushing the abrasive from the hopper 129.

Figure 3:
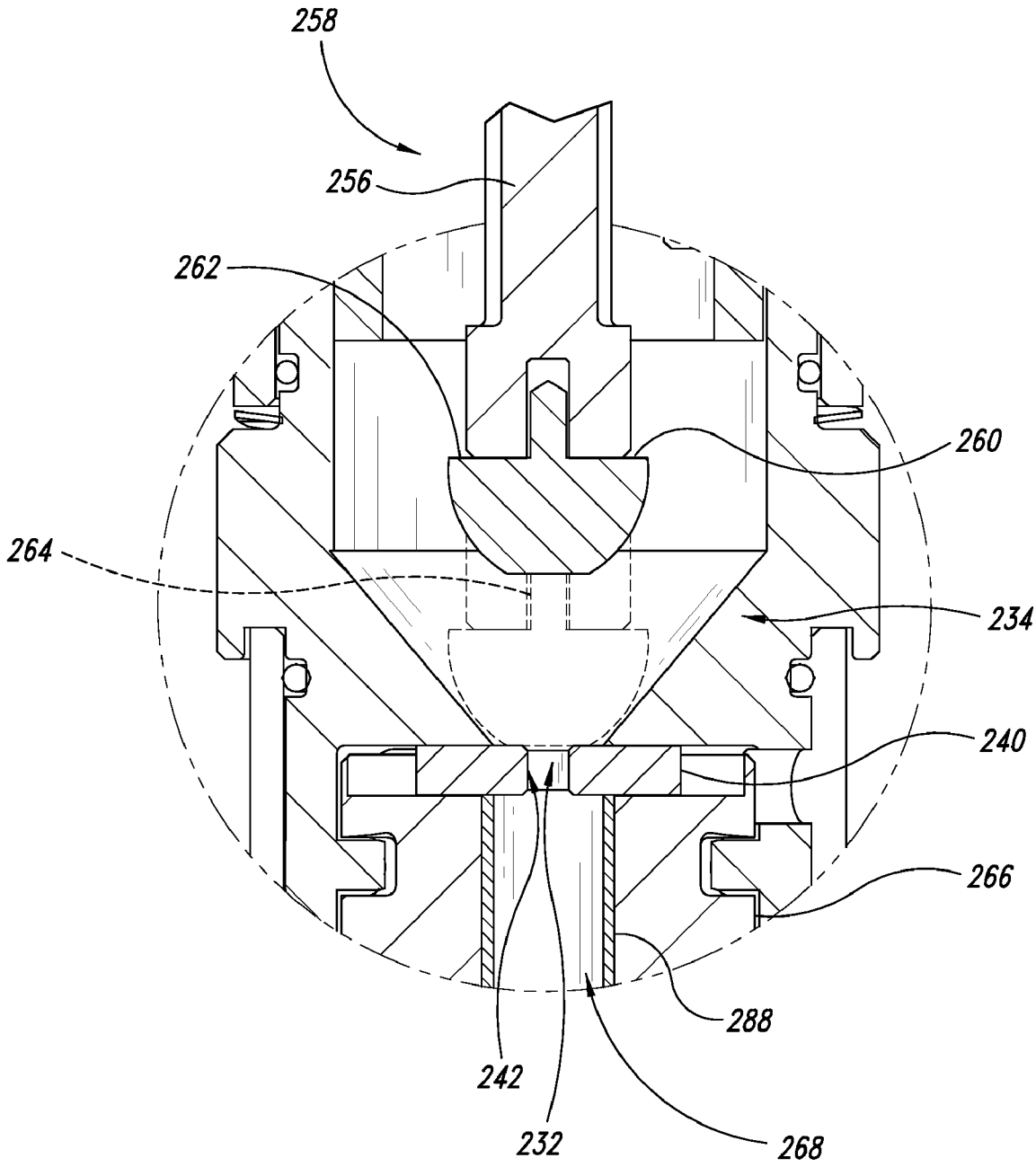
FIG. 3 is a detailed cross-sectional view of a portion of a metering unit of FIG. 2.

The air isolator 212 of FIGS. 2 and 3 further includes a bottom region 234 that includes a discharge orifice 232 being selectively opened or closed via operation of a flow control device 258, illustrated as an ON/OFF device. The ON/OFF device 258 comprises a rod 256 selectively raised to a first position 262 and lowered to a second position 264 (shown in broken line in FIG. 3) via a pneumatic cylinder 219. The rod 256 is coupled to a stopper 260 which covers the discharge orifice 232 when the rod 256 is in the lowered position 264, thereby preventing the discharge of abrasive from the air isolator 212. When the rod 256 moves towards the first position 262 (e.g., partially or fully raised), a stream of abrasive can pass through the discharge orifice 232. The distance between the stopper 260 and the discharge orifice 232 can be increased or decreased to increase or decrease the flow rate of abrasive out of the first metering unit 130.

Referring to FIG. 3, a metering disk 240 having an orifice 242 is provided adjacent the bottom region 234 of the air isolator 212. The orifice 242 of the metering disk 240 is generally aligned with the discharge orifice 232. The size of the metering disk orifice 242 can help control the flow rate of abrasive out of the first metering unit 130, and it may therefore be selected and changed, depending on the desired flow rate.

Abrasive passes through the metering disk 240 and enters a passageway 268 of an adapter 266. As shown in FIG. 2, abrasive can flow downwardly from the metering disk 240 through a line 288 and into the mixing manifold 280 due to gravity. After passing through the mixing manifold 280, the abrasive flows through an abrasive feed line 289 coupled to the cutting head assembly 118.

A line 282 extends between the second metering unit 133 and the mixing manifold 280. If both metering units 130, 133 output abrasive, the mixing manifold 280 combines the streams of abrasive delivered through the lines 282, 288 and delivers the abrasive mixture to the feed line 289. In this manner, abrasive is gravity fed through one or both of the metering units 130, 133 and into the mixing manifold 280.

Figure 4:
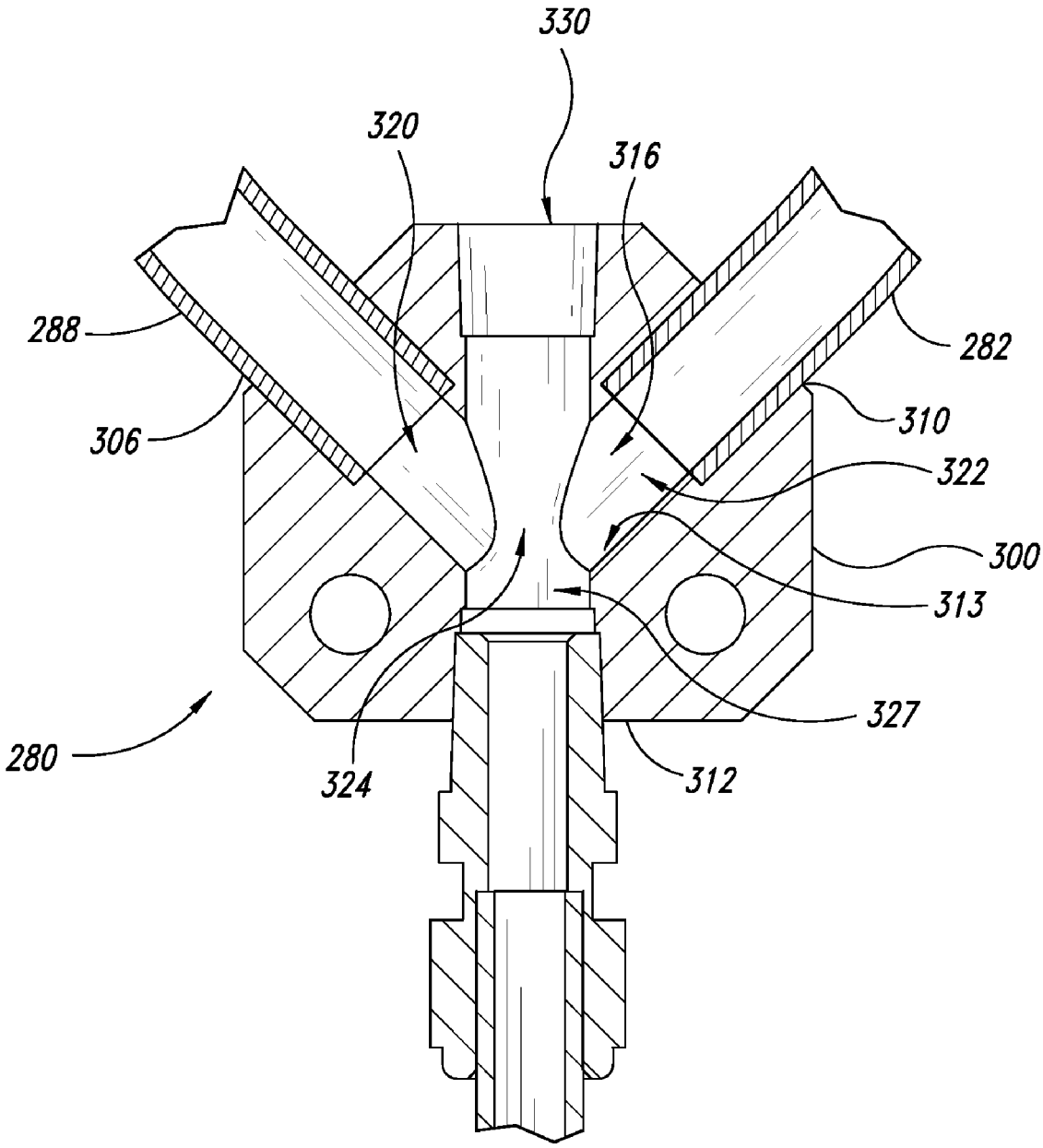
FIG. 4 is a detailed cross-sectional view of a mixing manifold of FIG. 2.

FIG. 4 shows the mixing manifold 280 in the form of a wye connector that includes a main body 300 defining an inlet 306 coupled to the line 288, an inlet 310 coupled to the line 282, and an outlet 312 coupled to the feed line 289. An inner surface 313 of the main body 300 defines a passageway 316, illustrated as a generally Y-shaped passageway, with diverging sections 320, 322. The inlet 306 is at the upstream end of the section 320, and the inlet 310 is at the upstream end of the section 322.

A junction 324 defines a mixing region (illustrated as a space) suitable for allowing flows of abrasive to mix together to produce a desired abrasive blend. For example, a flow of abrasive in the section 320 and a flow of abrasive in the section 322 are combined together at the junction 324 to form a blend passing into the line 289. The shape and configuration of the mixing region can be selected based on the desired mixing of the abrasives, flow rates through the mixing manifold 280, and the like. The abrasive blend can flow out of the mixing manifold 280 via a passageway 327 between the junction 324 and the outlet 312.

Various types of connections can be used to couple the lines 282, 288, 289 to the mixing manifold 280. By way of example, the line 288 can be press-fit into the inlet 306 in the form of an opening. In other embodiments, the line 288 has external threads that mate with internal threads of the inlet 306. In yet other embodiments, the inlet 306 includes one or more fittings, plugs, or other types of features for permanently or temporarily coupling to the line 288.

The mixing manifold 280, in some embodiments, can also include a venting port 330 for controlling the flow of abrasive within the passageway 316. FIG. 4 shows the venting port 330 as a straight through-hole for delivering air to a location that is downstream of both the inlets 306, 310. The illustrated mixing manifold 280 has a through-hole that forms the venting port 330, a portion of the junction 324, and the outlet 312. The mixing manifold 280 can also include additional venting ports, if needed or desired.

The venting port 330 promotes mixing of abrasive from the line 282 and abrasive from the line 288 to consistently produce a generally uniform abrasive blend. The abrasive blend flows out of the mixing manifold 280 and through the abrasive feed line 289 via gravity or a vacuum generated by a high-pressure fluid jet in the cutting head assembly 118, or both. Even if the flow rates of the streams of abrasive are significantly different, the mixing manifold 280 can output a generally steady stream of abrasive blend because of external ambient air flowing downwardly through the venting port 330 and into the passageway 316. Even if a relatively large amount of abrasive is continuously delivered through the inlet 306 and a relatively small amount of abrasive is continuously delivered through the inlet 310, a sufficient amount of ambient air may be drawn through the venting port 330 to provide for consistent mixing. Accordingly, venting can help reduce, limit, or substantially prevent unwanted accumulation of abrasive within the mixing manifold 280 while promoting the blending process.

Figure 5:
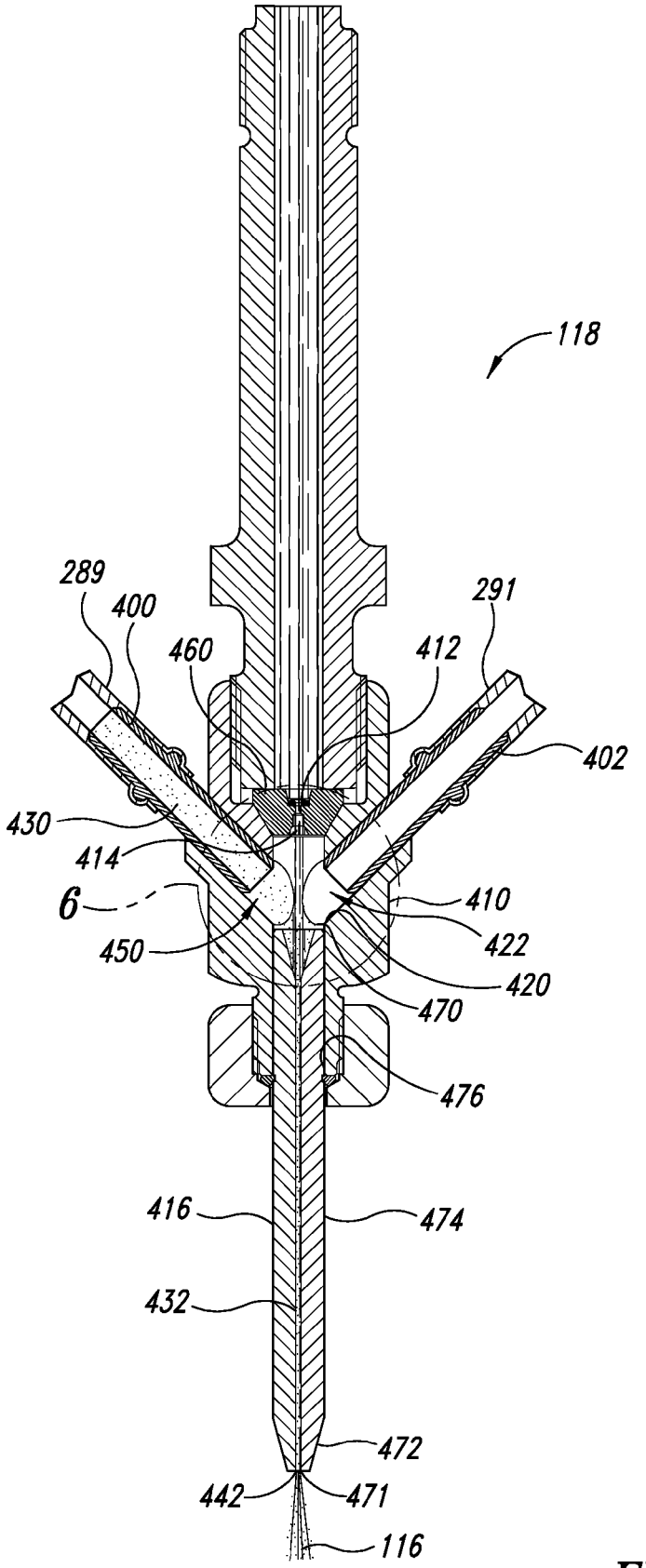
FIG. 5 is a cross-sectional view of a cutting head assembly, in accordance with one embodiment.

Referring to FIG. 5, the cutting head assembly 118 includes an abrasive inlet 400 coupled to the feed line 289 and an auxiliary inlet 402 that may be selectively coupled to the line 291. The cutting head assembly 118 generally includes a cutting head body 410, an orifice member 412 for producing a fluid jet 414 within the body 410, and a mixing tube 416 coupled to the body 410. The cutting head body 410 has an interior surface 420 that defines at least a portion of a mixing chamber 422. In some embodiments, including the illustrated embodiment, the mixing chamber 422 is generally the space between an orifice mount 460, which supports the orifice member 412, and the mixing tube 416. The abrasive inlet 400 defines at least a portion of a flow path between the feed line 289 and the mixing chamber 422, and the inlet 402 defines at least a portion of a flow path between the line 291 and the mixing chamber 422.

The cutting head assembly 118 can be for ultrahigh pressures, medium pressures, low pressures, or combinations thereof. Ultrahigh pressure cutting head assemblies can operate at pressures equal to or greater than about 80,000 psi (551 MPa). High-pressure cutting head assemblies can operate at a pressure in the range of about 50,000 psi (345 MPa) to about 90,000 psi (621 MPa). Medium-pressure cutting head assemblies can operate at a pressure in the range of about 15,000 psi (103 MPa) to about 50,000 psi (345 MPa). Low-pressure cutting head assemblies can operate at a pressure in the range of about 10,000 psi (69 MPa) to about 40,000 psi (276 MPa).

The illustrated cutting head body 410 has a one-piece construction formed via a machining process, for example. The cutting head body 410 can be made, in whole or in part, of one or more metals (e.g., steel, high strength metals, etc.), metal alloys, or the like. Threads or other coupling features of the cutting head body 410 can thus be for coupling to other components, even when significant pressures are reached within the body 410. Because the cutting head body 410 has a reliable one-piece construction, it is not prone to malfunction. Therefore, even though other components of the cutting head assembly 118, such as the mixing tube 416, may be frequently replaced, the cutting head body 410 has a relatively long working life, as compared to other components, and provides consistent, reliable operation.

The orifice mount 460 is fixed with respect to the cutting head body 410 and includes a recess dimension to receive and to hold the orifice member 412. The orifice member 412 is thus kept in proper alignment with the mixing chamber 422 and a passageway 432 of the mixing tube 416. The configuration and size of the orifice member 412 and the orifice mount 460 can be selected based on the desired position and orientation of the fluid jet 414 entering the mixing chamber 422. The orifice member 412, in some embodiments, is an orifice jewel or other fluid jet or cutting stream producing device used to achieve the desired flow characteristics of the resultant fluid jet 414. The opening of the orifice member 412 can have a diameter in a range of about 0.001 inch (0.025 mm) to about 0.02 inch (0.5 mm). Openings with other diameters can also be used, if needed or desired.

The orifice mount 460 defines an upstream end of the mixing chamber 422, and the mixing tube 416 defines a downstream end of the mixing chamber 422. The mixing chamber 422 includes a relatively wide central region 450 in which abrasive 430 is entrained. The illustrated mixing chamber 422 has a cross-sectional area that is larger than a cross-sectional area of the passageway 432 of the mixing tube 416. The cross-sectional area of the mixing chamber 422 and the cross-sectional area of the passageway 432 are taken generally perpendicularly to a direction of travel of the fluid jet 414 passing through the mixing chamber 422.

Figure 6:
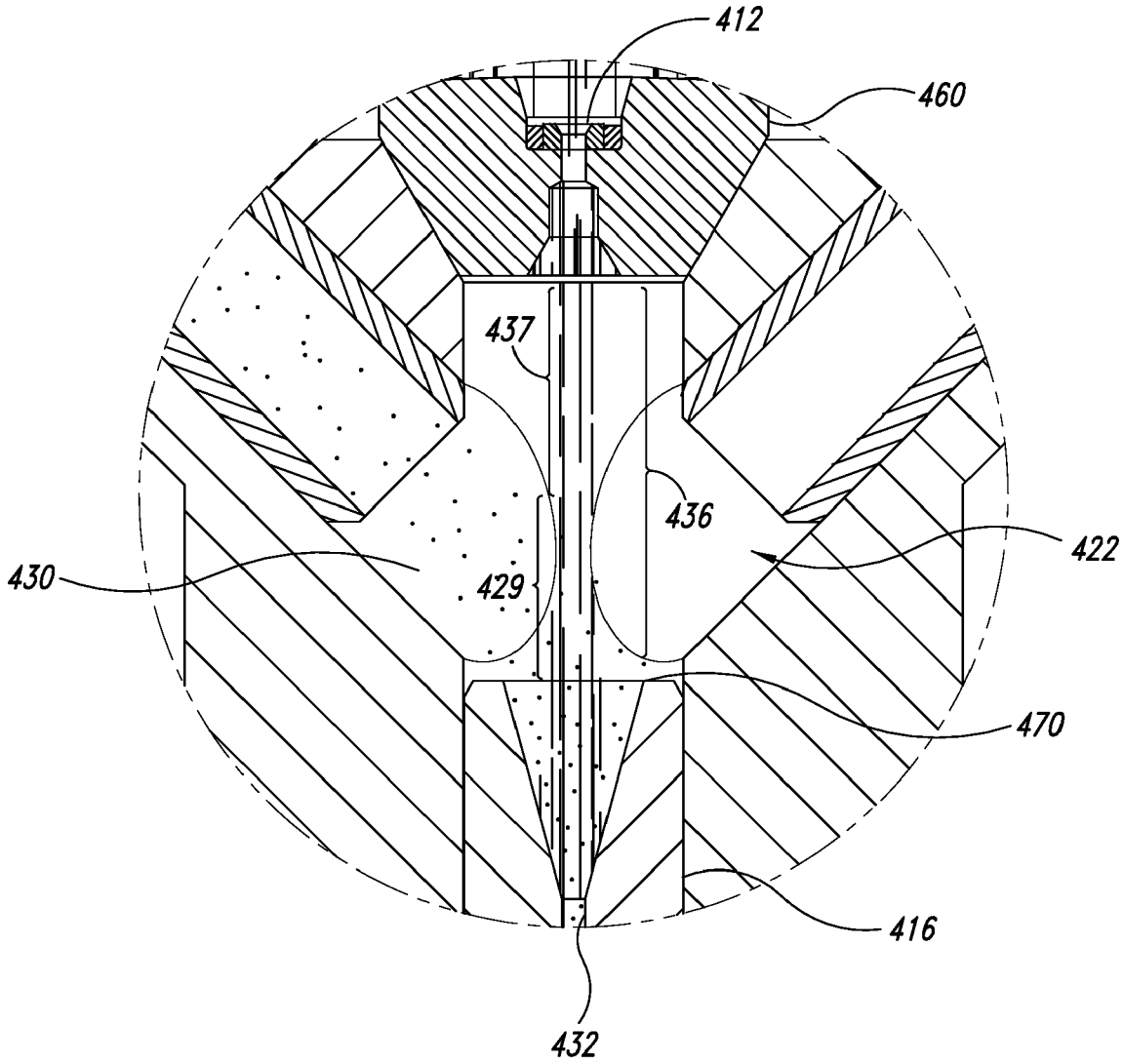
FIG. 6 is a detailed cross-sectional view of a portion of the cutting head assembly of FIG. 5.

The illustrated mixing chamber 422 of FIGS. 5 and 6 is a single-stage entrainment chamber in which substantially the entire entrainment process occurs. The stream of abrasive 430 can be continuously entrained in at least a portion of a section 436 of the fluid jet 414 between the orifice mount 460 and the mixing tube 416. The illustrated fluid jet 414 exits the orifice member 412 directly into the mixing chamber 422. The abrasive 430 within the mixing chamber 422 is entrained in the fluid jet 414 to form the abrasive jet flowing through the passageway 432. The abrasive 430 is therefore entrained before entering the upstream end 470 of the mixing tube 416. The entrained abrasive may continue to mix together while traveling along the passageway 432.

The mixing chamber 422, in some embodiments, is configured and dimensioned to evenly entrain the constituents of the abrasive 430 downstream of the orifice mount 460, such that the upstream portion 437 of the fluid jet 414 may be substantially free of any appreciable amount of abrasive. The abrasive 430 flows into a downstream portion 429 of the fluid jet 414, illustrated between the upstream portion 437 and the mixing tube 416. For example, the upstream portion 437 can comprise mostly or entirely fluid (e.g., at least 95% water by weight), while an abrasive 430 enters the downstream portion 429 to form the abrasive jet entering the mixing tube 416. Thus, the abrasive 430 does not cause wearing of the orifice mount 460.

If the abrasive 430 is an abrasive blend, the different abrasives are generally accelerated together and simultaneously entrained. As such, even if the abrasive particles have significantly different sizes, masses, or physical properties (e.g., hardness, toughness such as fracture toughness, abrasion resistance, and the like), the abrasive particles can be introduced into and subsequently carried by the jet without an appreciable amount of damage to the abrasive particles due to the abrasive particles colliding with one another. In contrast, separately entraining dissimilar abrasives (e.g., hard or ultra-hard abrasives and soft abrasive) using a conventional multi-staged entrainment process may result in an appreciable amount of damage to one or both of the abrasives, thereby significantly reducing performance. If dissimilar abrasives are consecutively entrained in a fluid jet, the abrasive entrained downstream may be damaged (e.g., broken apart) by any abrasive entrained upstream, thereby causing reduced performance and unwanted damage to components of the nozzle system. For example, abrasive entrained upstream moves at a high speed towards abrasive being introduced into the abrasive jet at a downstream location. These abrasives collide causing the abrasives to break apart into relatively small fragments that are smaller than desired for optimal performance. For example, the damaged abrasives may significantly reduce cutting speeds. Additionally, collision between the abrasives can cause the abrasives to spread laterally outward towards and to impact components of the waterjet system, such as the mixing tube. The amount of abrasive that strikes the components and the associated impact forces may be significant, thereby resulting in relatively high wear rates.

Because the different abrasives of the abrasive 430 of FIG. 5 are entrained substantially simultaneously and accelerated at generally the same rate of acceleration, damage to the abrasives can be kept at or below an acceptable level, for example, significantly lower than the damage associated with consecutively entrained abrasives. The different abrasives forming the abrasive 430 also do not tend to spread outwardly as much as conventional systems that consecutively entrain abrasives, thus keeping wear rates of components, such as the mixing tube, at or below an acceptable level.

In some embodiments, the abrasive 430 comprises a first abrasive having particles in a range of about 60 mesh to about 120 mesh and a second abrasive having particles in a range of about 50 mesh to about 100 mesh. The rate of acceleration of the first abrasive is generally equal to or slightly less than the rate of acceleration of the second abrasive to minimize, limit, or substantially prevent a sufficient amount of damage to one or both abrasives which would decrease processing performance.

As shown in FIG. 5, the mixing tube 416 has the upstream end 470, a downstream end 471, and a main body 474 extending between the upstream and downstream ends 470, 471. The main body 474 is positioned within a bore 476 of the cutting head body 410 and extends away from the cutting head body 410 and terminates at the downstream end 471, illustrated as a blunted tip 472. The tip 472 defines an outlet 442 through which the jet 116 exits the mixing tube 416. In one embodiment, the tip 472 is configured to produce a round jet. In other embodiments, the tip 472 produces other types of jets, such as a fan jet. The longitudinal length of the mixing tube 416, the diameter of the passageway 432, and other design parameters can be selected to achieve the desired mixing action, jet shape, or the like, as is known in the art.

The mixing tube 416 can be a focusing tube, delivery conduit, or other delivery tube or device configured to produce a desired flow. In some embodiments, the mixing tube 416 extends continuously and uninterruptedly between the upstream and downstream ends 470, 471. For example, the mixing tube 416 can be a one-piece tube. In other embodiments, the mixing tube 416 is a multi-piece tube. If a section of the multi-piece tube is damaged, that section can be replaced in order to reuse other sections of the mixing tube 416.

Different types and arrangements of orifices, cutting heads, mixing chambers, and mixing tubes can be utilized with embodiments and features of the present invention. Thus, the system of the present invention can also work with any other type of waterjet or abrasive jet system, regardless of the particular structure and arrangement of the orifice, mixing chamber, and mixing tube. The illustrated embodiment of FIG. 5 has a traditional arrangement for the orifice, cutting head, and mixing tube. In other embodiments, the system can have the orifice integrally formed with another component, the mixing chamber can be in a cartridge, or the like, as is known in the art.

In various embodiments, the waterjet system 100 of FIGS. 1 and 2 may generate a wide range of different types of jets during different portions of a single manufacturing process or during different manufacturing processes. Some exemplary modes of operation are detailed below. If different portions of the workpiece 119 have different material properties (e.g., hardnesses, wear characteristics, etc.), the abrasive delivery system 124 can vary the characteristics of the jet 116 based, at least in part, on one or more of those material properties.

Figure 7:
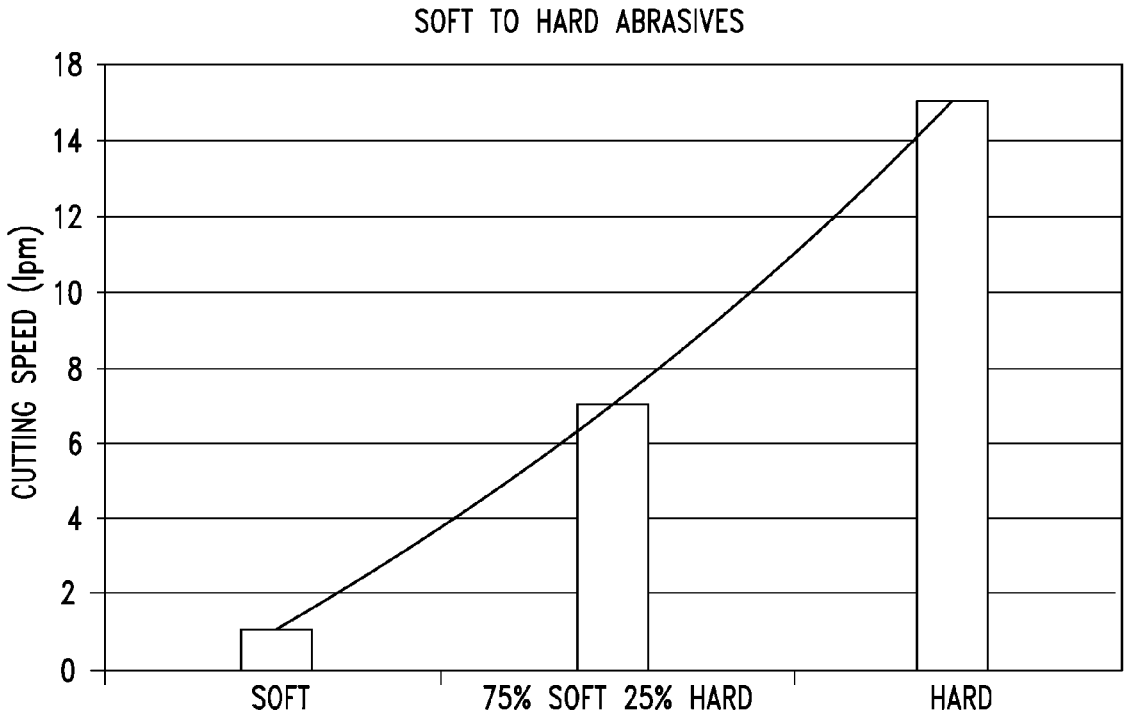
FIG. 7 is a plot of abrasive compositions of abrasive jets versus cutting speeds for cutting a hard material.

FIG. 7 shows the abrasive used to make the jets versus the cutting speed for different abrasive jets. For example, an abrasive mixture made of 75% by weight of soft abrasive and 25% by weight of hard abrasive can be about 7 inches/minute, whereas the soft abrasive alone results in a cutting rate of about 1 inch/minute.

In some modes of operation, the first and second feed apparatuses 126, 128 concurrently and/or sequentially output relatively soft and hard abrasives, respectively. For example, the first and second feed apparatuses 126, 128 can sequentially deliver abrasive to the cutting head assembly 118 to form the single-abrasive jets 116. If the workpiece 119 is made of a relatively soft material, the first feed apparatus 126 is turned ON and delivers soft abrasive to the mixing manifold 280. The soft abrasive flows out of the mixing manifold 280, through the feed line 289, and into the cutting head assembly 118. The cutting head assembly 118 uses the abrasive to form the single-abrasive jet 116. During this process, the second feed apparatus 128 is in the OFF state. If the workpiece 119 is made of a relatively hard material, the second feed apparatus 128 is turned ON and the first feed apparatus 126 is turned OFF. The second feed apparatus 128 outputs a relatively hard abrasive, such as aluminum oxide abrasive, that is delivered to the cutting head assembly 118.

To generate abrasive blends, both first and second feed apparatuses 126, 128 are in the ON state. The abrasive delivery system 124 selectively produces the blend in which the relative amounts of the constituents of the abrasive blend can be adjusted by varying the flow rates of abrasives outputted by the corresponding first and second abrasive feed apparatuses 126, 128. A flow of abrasive from the first feed apparatus 126 and a flow of abrasive from the second feed apparatus 128 are concurrently delivered into the mixing manifold 280.

In some embodiments, the first feed apparatus 126 is configured to output the first abrasive at a flow rate that is independent of the flow rate of the second abrasive outputted by the second abrasive feed apparatus 128, thereby allowing rapid varying of the abrasive blend. The abrasive blend can be a mixture of two or more abrasives with different hardnesses (e.g., a mixture of a soft abrasive and a hard abrasive, a mixture of a hard abrasive and an ultra-hard abrasive, a mixture of a soft abrasive, a hard abrasive, and an ultra-hard abrasive, or the like), mesh sizes, or other characteristics. In some embodiments, the entrained abrasive comprises at least 10% by weight of soft abrasive or at least 10% by weight of hard or ultra abrasive. In some embodiments, the entrained abrasive comprises about 10-40% by weight of soft abrasive and/or at least 60-90% by weight of hard abrasive. Such embodiments are well suited for processing workpieces 119 made of ceramics or other relatively hard materials. In some embodiments, the entrained abrasive comprises about 20% to about 30% by weight of soft abrasive and about 70% to about 80% by weight of hard abrasive such that the jet 116 is capable of cutting hard materials while keeping wear rates of the mixing tube 416 at or below an acceptable level. Any desired ratio of any two or more abrasives can be selected based on desired criteria, such as processing speeds (e.g., cutting speeds, deburring speeds, drilling speeds), processing tolerances, finishes (e.g., smooth finishes, rough cuts, and the like), wear rates of one or more waterjet system components (e.g., a mixing tube, a cutting head body, and the like), material costs of abrasives, working pressures, and the like. For example, the relative amount of hard or ultra-hard abrasive can be increased or decreased to increase or decrease, respectively, cutting speeds or working pressures. The relative amount of hard or ultra-hard abrasive can also be increased for smoother finishes. The relative amount of hard or ultra-hard abrasive can be decreased to decrease wear rates of the mixing tube and decrease abrasive material costs.

In other embodiments, the first abrasive feed apparatus 126 outputs the first abrasive at a flow rate that is dependent on a flow rate of the second abrasive outputted by the second abrasive feed apparatus 128. Such embodiments can maintain a desired ratio between the abrasives.

The number of abrasive feed apparatuses can be increased to increase the number of different abrasives available to produce abrasive jets. For example, additional abrasive sources and metering units can be incorporated into the illustrated system 100 of FIG. 1 to produce abrasive jets comprising more than two abrasives. Components of the system 100 can have a modular construction for convenient reconfiguration, thereby reducing installation time of these additional components.

Advantageously, the wear rate of the mixing tube 416 associated with the abrasive jet 116 produced by simultaneously entraining first and second abrasives is less than the wear rates associated with multi-stage entrainment processes. As such, an abrasive blend that includes an abrasive with a relatively large mesh size and an abrasive with a relatively small mesh size can be entrained at the same time without the abrasive with the relatively large mesh size causing an appreciable amount of damage (e.g., fracturing) of the other abrasive or damage to the mixing tube 416. Accordingly, the system 100 can produce multi-abrasive jets comprising a wide range of different grit abrasives.

Figure 8:
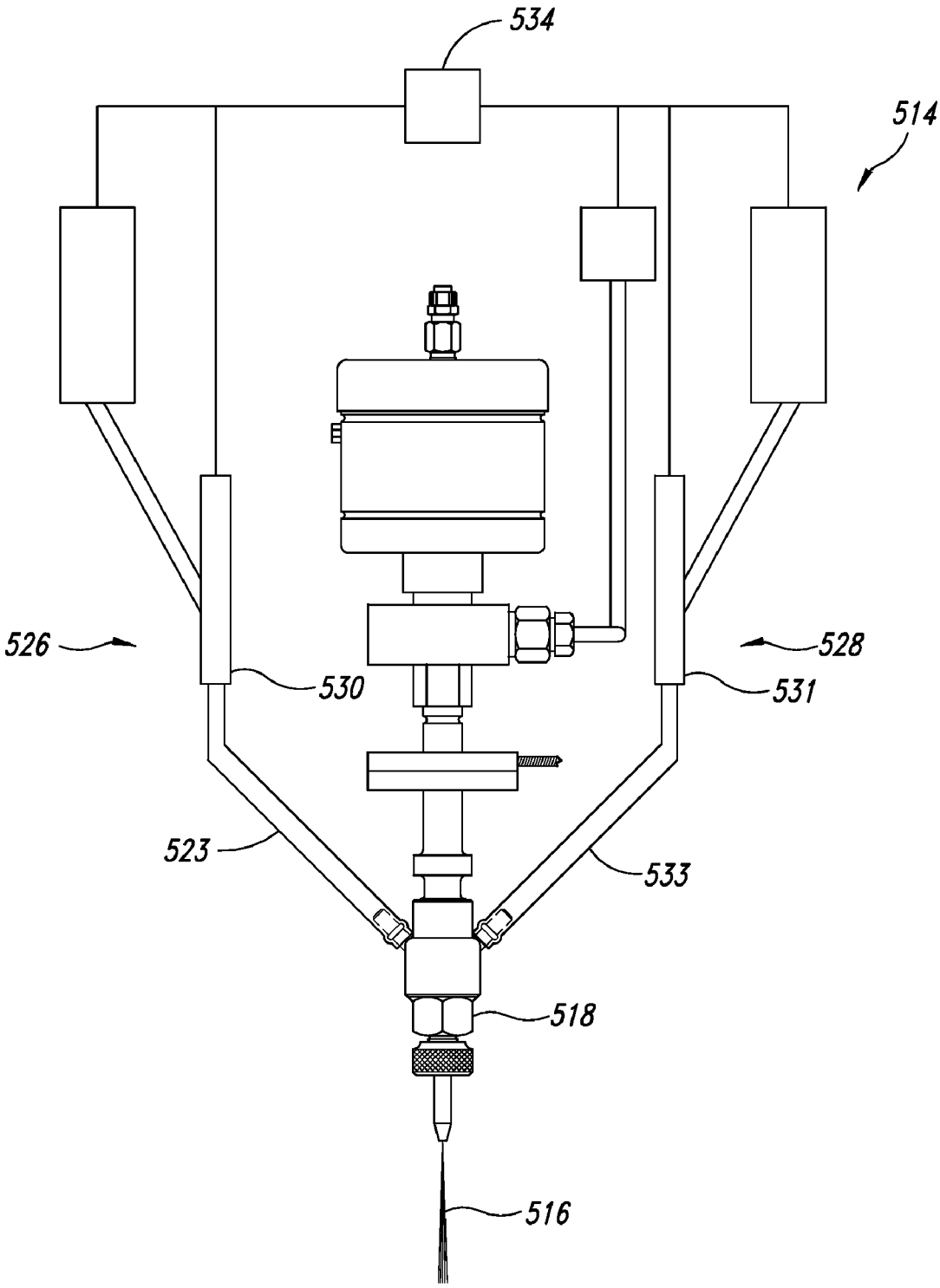
FIG. 8 is an elevational view of a waterjet system for producing abrasive jets, in accordance with one embodiment.

FIG. 8 shows an abrasive delivery system 514 that is generally similar to the abrasive delivery system 124 discussed in connection with FIGS. 1-6, except as detailed below. The abrasive delivery system 514 delivers separate flows of abrasive to a cutting head assembly 518. The cutting head assembly 518 receives and combines the separate flows of abrasive to produce a multi-abrasive jet 516. The delivery system 514 can feed a single abrasive (either from a first abrasive metering unit 530 or a second abrasive metering unit 531) or can simultaneously feed abrasives from the first and second metering unit 530, 531.

Figure 9:
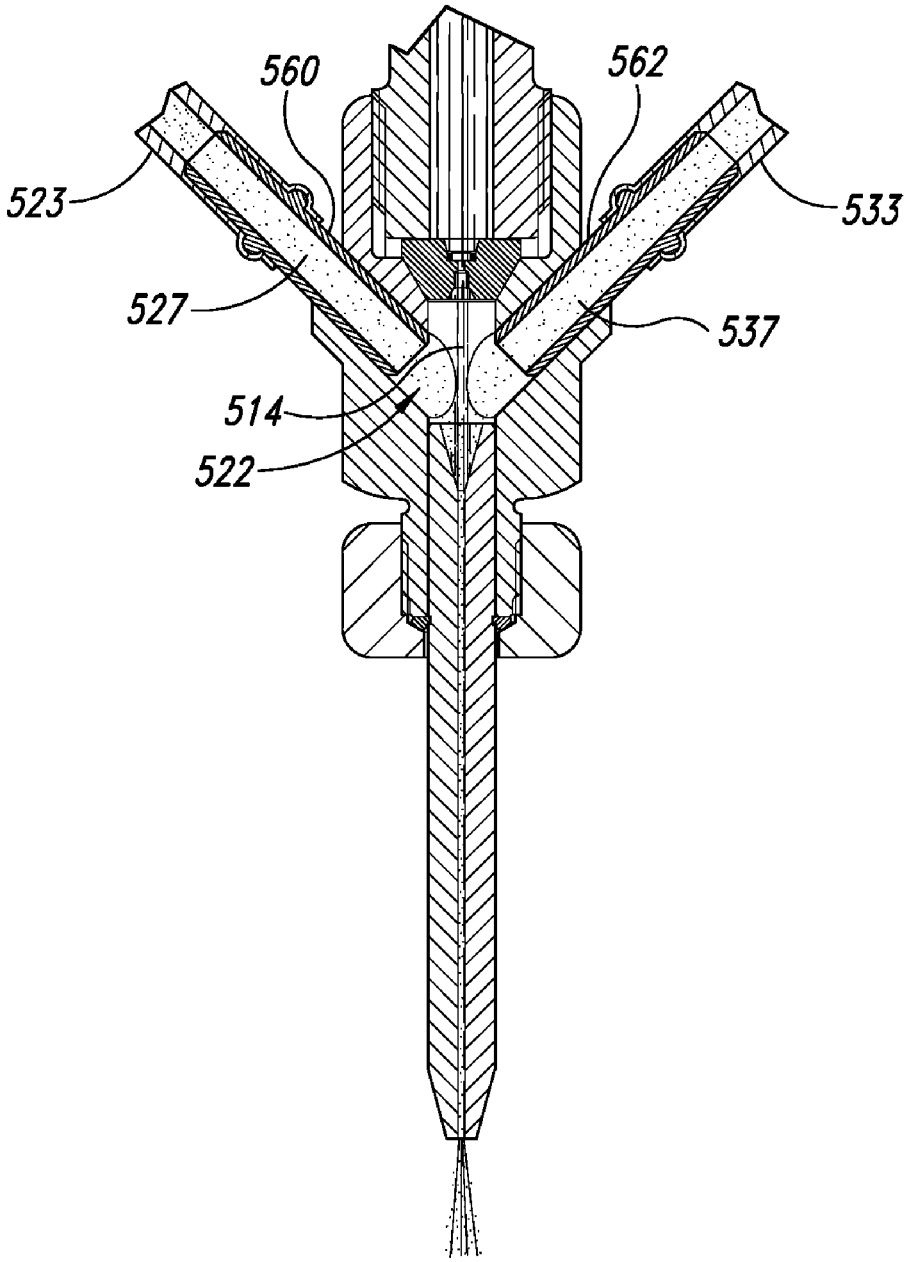
FIG. 9 is a cross-sectional view of a portion of a cutting head assembly of FIG. 8.

Referring to FIGS. 8 and 9, a first abrasive feed line 523 extends between a first abrasive feed apparatus 526 and the cutting head assembly 518 such that a first abrasive material 527 passing through the first abrasive feed line 523 is delivered directly into a mixing chamber 522. A second abrasive feed line 533 extends between a second abrasive feed apparatus 528 and the cutting head assembly 518 such that the second abrasive material 537 passing through the second abrasive feed line 533 is delivered directly into the mixing chamber 522. The mass flow rates of first and second abrasives can be independently increased or decreased.

The mixing chamber 522 includes a first inlet 560 and an opposing second inlet 562. The first abrasive material 527 enters the mixing chamber 522 via the first inlet 560, and the second abrasive material 537 enters the mixing chamber 522 via the second inlet 562. Because the first and second inlets 560, 562 are on opposite sides of the mixing chamber 522, the abrasives 527, 537 can be introduced at opposing sides of the fluid jet 514. As such, the abrasives 527, 537 are concurrently picked-up by the fluid jet 514. The abrasives 527, 537 can further mix within the jet 514 to produce an entrained abrasive blend, for example, a homogenous blend or a heterogeneous blend. In this manner, the jet 514 can help produce the abrasive blend.

Abrasive blends can also be introduced into the fluid jet 514. Each of the first and second abrasives 527, 537, for example, can be an abrasive blend. In some embodiments, the first abrasive 527 is a mixture of at least two soft abrasives, and the second abrasive 537 is a mixture of at least two hard abrasives. These abrasive blends 527, 537 are entrained in the jet 514 to produce an abrasive jet having a plurality of soft abrasives and a plurality of hard abrasives.

The abrasives 527, 537 may be combined together before entering the jet 514. In some embodiments, at least a portion of the abrasive 527 within the mixing chamber 522 mixes with at least a portion of the abrasive 537 within the mixing chamber 522. The blend of the abrasives 527, 537 is then introduced into the fluid jet 514. In some embodiments, the first abrasive material 527 and the second abrasive material 537 circulate within the mixing chamber 522. The circulating abrasives 527, 537 can form a generally homogenous mixture that is subsequently entrained. Various types of venting ports can be incorporated into the cutting head body to achieve the desired mixing. The flow rate of the first and second abrasives 527, 537 can be adjusted to control the ratio of abrasives within the fluid jet, as well as the position and orientation of the first and second inlets 560, 562.

Figure 10:
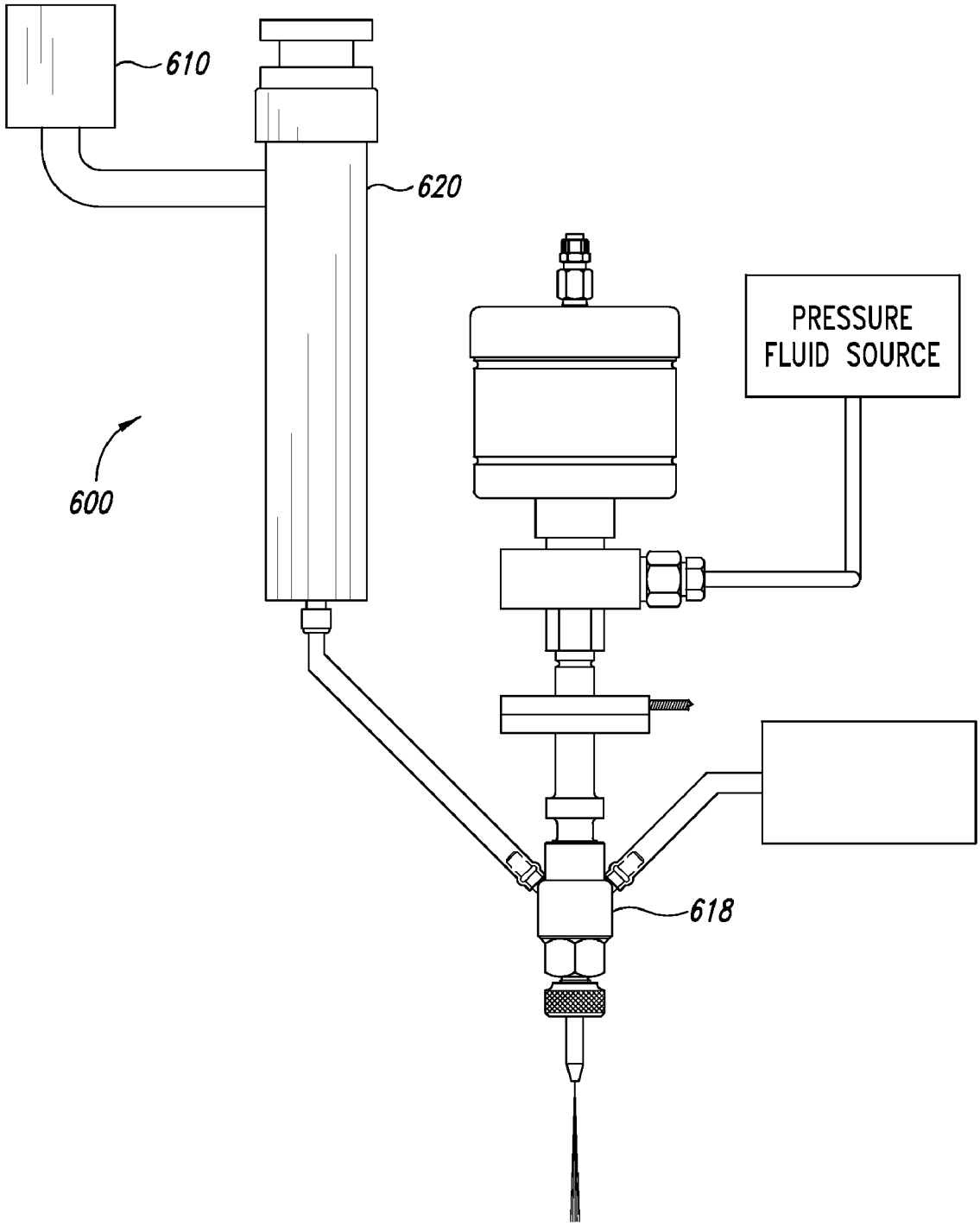
FIG. 10 is an elevational view of a waterjet system that has an abrasive delivery system for delivering an abrasive blend to a cutting head assembly, in accordance with one embodiment.

FIG. 10 shows an abrasive delivery system 600 that delivers an abrasive blend to a cutting head assembly 618. An abrasive source 610 stores and dispenses the premixed abrasive blend to an abrasive metering unit 620. The metering unit 620 controls delivery of the abrasive blend to the cutting head assembly 618. In this manner, an abrasive blend having a generally consistent composition can be delivered to the cutting head assembly 618. Additionally, the abrasive source 610 can be filled with different types of abrasive blends to process different workpieces.

The abrasive delivery systems disclosed herein can be utilized with a wide range of cutting head assemblies. For example, the abrasive delivery systems can be used with the abrasive jet fluid system disclosed in U.S. Pat. No. 5,643,058, as well as other well-known systems. In some embodiments, the abrasive delivery system 124 is installed aftermarket in a waterjet system. For example, a conventional abrasive jet system that generates an abrasive jet can be modified to output a multi-abrasive jet using the abrasive delivery system 124. In other embodiments, the entire waterjet systems are manufactured by the original equipment manufacture.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An abrasive waterjet system, comprising:

a first abrasive feed apparatus adapted to output a first abrasive material;

a second abrasive feed apparatus adapted to output a second abrasive material;

a mixing manifold configured to mix the first abrasive material from the first abrasive feed apparatus and the second abrasive material from the second abrasive feed apparatus to produce an abrasive blend; and a cutting head assembly including an orifice member configured to produce a waterjet and including a mixing chamber downstream of the orifice member, the mixing chamber configured to receive the abrasive blend and to concurrently combine both the first abrasive material and the second abrasive material of the abrasive blend with a section of the waterjet located in the mixing chamber to produce a multi-abrasive jet to process a workpiece.

2. The abrasive waterjet system of claim 1, wherein the first abrasive feed apparatus is configured to output the first abrasive material at a flow rate that is independent of a flow rate of the second abrasive material outputted by the second abrasive feed apparatus.

3. The abrasive waterjet system of claim 1, wherein the mixing chamber is configured to enable the first abrasive material and the second abrasive material to be substantially evenly entrained in the waterjet.

4. The abrasive waterjet system of claim 1, further comprising:

a controller communicatively coupled to the first abrasive feed apparatus and the second abrasive feed apparatus, the controller configured to control a feed rate of the first abrasive material delivered to the cutting head assembly and a feed rate of the second abrasive material delivered to the cutting head assembly.

5. The abrasive waterjet system of claim 4, wherein the first abrasive feed apparatus includes a first hopper for holding the first abrasive material and a first metering unit for receiving the first abrasive material from the first hopper, the second abrasive feed apparatus includes a second hopper for holding the second abrasive material and a second metering unit for receiving the second abrasive material from the second hopper, and the controller is configured to control the first metering unit and the second metering unit so as to adjust a ratio of the first abrasive material to the second abrasive material of the abrasive blend that is delivered to the cutting head assembly.

6. The abrasive waterjet system of claim 1, wherein the first abrasive feed apparatus includes a first metering unit for receiving and dispensing the first abrasive material from a first hopper, and the second abrasive feed apparatus includes a second metering unit for receiving and dispensing the second abrasive material from a second hopper.

7. The abrasive waterjet system of claim 1, further comprising:

a feed line extending between an outlet of the mixing manifold and an inlet of the cutting head assembly through which the abrasive blend enters the mixing chamber.

8. A method for producing a multi-abrasive waterjet to process workpieces, the method comprising:

producing a waterjet;

mixing a first abrasive and a second abrasive together to produce a multi-abrasive blend; and delivering a flow of the multi-abrasive blend into a mixing chamber in a cutting head assembly of a waterjet system; and simultaneously entraining the first abrasive and the second abrasive of the multi-abrasive blend into a section of the waterjet within the mixing chamber to form the multi-abrasive waterjet.

9. The method of claim 8, wherein the waterjet is substantially free of any appreciable amount of abrasive prior to the simultaneous entrainment of the first abrasive and the second abrasive.

10. The method of claim 8, further comprising:

delivering the first abrasive from a first metering unit into a mixing manifold coupled to the cutting head assembly by a feed line;

delivering the second abrasive from a second metering unit into the mixing manifold to produce the multi-abrasive blend including the first abrasive and the second abrasive.

11. The method of claim 8, wherein the entrained abrasive in the multi-abrasive waterjet comprises at least 90% by weight of garnet abrasive and at least 10% by weight of aluminum oxide abrasive.

12. A method for producing a multi-abrasive waterjet to process workpieces, the method comprising:

producing a non-abrasive waterjet passing through a mixing chamber in a cutting head assembly;

combining a first abrasive and a second abrasive to form a multi-abrasive blend; and entraining the multi-abrasive blend into a section of the non-abrasive waterjet located within the mixing chamber.

13. The method of claim 12, wherein the section of the non-abrasive waterjet becomes a multi-abrasive waterjet as the first abrasive and the second abrasive are entrained.

14. The method of claim 12, further comprising:

mixing the first abrasive and the second abrasive in a mixing manifold to produce the multi-abrasive blend while producing the non-abrasive waterjet in the cutting head assembly; and delivering the multi-abrasive blend through at least one inlet of the cutting head assembly and into the mixing chamber.

15. The method of claim 12, wherein the first abrasive has a first hardness, the second abrasive has a second hardness, and a ratio of the first hardness to the second hardness is in a range of about 0.2 to about 0.8 on a Moh scale.

16. The method of claim 12, wherein the first abrasive and the second abrasive have different mesh sizes.

17. The method of claim 12, further comprising entraining the first abrasive or the second abrasive to produce a single-abrasive waterjet outputted by the cutting head assembly.

18. The method of claim 17, wherein the single-abrasive waterjet is produced after producing the multi-abrasive waterjet.

* * * * *